US006314403B1

(12) United States Patent
Jeffery

(10) Patent No.: US 6,314,403 B1
(45) Date of Patent: Nov. 6, 2001

(54) APPARATUS AND METHOD FOR GENERATING A SPECIAL EFFECT ON A DIGITAL SIGNAL

(75) Inventor: Mark R. Jeffery, Berkeley, CA (US)

(73) Assignee: Avid Technology, Inc., Tewksbury, MA (US)

( * ) Notice: Subject to any disclaimer, the term of this patent is extended or adjusted under 35 U.S.C. 154(b) by 0 days.

(21) Appl. No.: 09/568,758

(22) Filed: May 11, 2000

(51) Int. Cl.[7] ..... G10L 21/00; G10L 11/00
(52) U.S. Cl. ..... 704/500; 704/270; 704/272
(58) Field of Search ..... 704/500–504, 704/211, 258

(56) References Cited

U.S. PATENT DOCUMENTS 5,604,323 * 2/1997 Hardie-Bick ..... 84/624
5,824,936 * 10/1998 DuPuis et al. ..... 84/627
5,930,755 * 7/1999 Cecys ..... 704/264
6,098,046 * 8/2000 Cooper et al. ..... 704/503

OTHER PUBLICATIONS

Goldenstein et al ("Time Warping of Audio Signals," Computer Graphics International, Jun. 1999).*

* cited by examiner

*Primary Examiner*—Richemond Dorvil
*Assistant Examiner*—Daniel A. Nolan
(74) *Attorney, Agent, or Firm*—Lawrence E. Monks; Peter J. Gordon

(57) ABSTRACT

The present invention provides a method and apparatus for generating at a computerized workstation a special effect that is derived by numerical processing of the digital sample values associated with an analog signal. The analog signal is partitioned into wavefragments which are crossfaded at both a micro and macro level to generate the effect.

20 Claims, 4 Drawing Sheets

APPARATUS AND METHOD FOR GENERATING A SPECIAL EFFECT ON A DIGITAL SIGNAL

FIELD OF THE INVENTION

The present invention relates generally to digital signal processing techniques for producing a special effect during the playing of a digital signal. The present invention relates more particularly to digital signal processing techniques for producing a special effect by performing crossfading at both a micro and macro level for sequences of the digital signal.

BACKGROUND OF THE INVENTION

Digital audio workstations (DAWs) are increasingly popular in the recording studio and post-production environments. Digital audio workstations are used to mix, amplify, control and otherwise affect either the audio portion of a multimedia event or a production, which is solely audio, such as a song or composition. Two important features desirable in any DAW are the DAW's ability to perform audio "tasks" (such as equalization, reverberation, etc.) in a real-time, efficient manner and the ability of the DAW to edit a digital waveform to produce an interesting effect. Recently, digital audio workstations have been implemented using a personal computer, a PC, with specialized sound cards for capture and playback. Because of the processing capability of the PC, a digital waveform can be easily modified prior to playing back the signal. New sounds can be generated that are variations on the original audio. Alternatively, the signal can be "cleaned up" by digital processing techniques to eliminate imperfections in the original sound.

The production of a multimedia program typically involves editing an audio signal to augment the signal in some fashion. The editing of the signal is performed on digital samples generated after an Analog-to-Digital conversion of the analog audio signal. The resulting digital samples may be manipulated using digital signal processing (DSP) techniques to modify the signal in some interesting manner. For example, the playback speed of the stored audio data is changed to produce a new sound that is derived from the original audio. This change alters the duration of the playback sound. A side-effect of this manipulation is a pitch change, that is often referred to as the "chipmunk" effect because of the high pitch that results when voice is played back at high speeds. This pitch change results in an interesting special effect.

Special effects are not limited to only changes in the pitch of the audio, but include other modifications to the signal that produce interesting audio results. An effect typically results from numerically processing a digital representation of the original analog signal by modifying the digital values to produce the special effect. A further example of a special effect that can be generated digitally is a crossfade from one digital waveform to another waveform. The crossfading operation produces a transition between the two signals by phasing in the second waveform from the first waveform in a defined manner. The progression of the crossfade is usually specified by the user and can be adapted to generate a customized sound.

In the entertainment industry, the generation of innovative audio special effects has become increasingly important. Whether it is a sound recording by an artist or an audio/visual work such as a film, a production with unusual visual and audio effects enhances the marketability of the product. Consequently, it is important to discover interesting and novel effects that are efficiently implemented on a workstation such as a digital audio workstation.

SUMMARY OF THE INVENTION

The present invention provides a method and apparatus for generating at a computerized workstation a special effect that is derived by numerical processing of the digital sample values associated with an analog signal.

In one aspect of the invention, a portion of the digital sample values is selected from the digital samples corresponding to the original analog signal, and partitioned into a first wavefragment and a second wavefragment.

In a further aspect of the invention, the first and second wavefragments are also partitioned into separate segments, and the separate segments for each of the wavefragments are crossfaded together to produce a micro special effect on the separate wavefragments.

In a yet further aspect of the invention, the partitioned segments for each of the wavefragments are crossfaded by summing corresponding weighted digital sample values from each of the partitioned segments for a particular wavefragment. In one practice of the invention, the weighted digital sample values are weighted according to a predetermined function. In one practice of the invention, the weighted digital sample values are weighted in a linearly increasing manner.

In a still further aspect of the invention, the result of the crossfaded segments for each wavefragment is crossfaded at a macro level with the crossfaded segments for the other wavefragment to produce a special effect. The wavefragments are crossfaded by summing corresponding weighted digital sample values from each of the wavefragments.

In a further aspect of the invention, the crossfade at the macro level is repeated by looping the crossfade operation to generate a predetermined frequency of crossfade. The frequency of crossfade may be a fractional frequency.

In a still further aspect of the invention, the analog signal may be an audio signal consisting of voiced or unvoiced audio. After the special effect, according to the invention, is digitally generated, the resulting digital values are input to a D/A converter to produce an analog signal corresponding to the special effect. The analog signal may drive audio speakers to generate an audio special effect.

A BRIEF DESCRIPTION OF THE DRAWINGS

A specific embodiment of the invention will be described, by way of example, with reference to the accompanying drawings in which.

DETAILED DESCRIPTION

While the present invention is described, for illustrative purposes, with reference to an audio application those of ordinary skill in the art will recognize that the invention is applicable to the generation of a special effect for any digital signal, regardless of the application. Therefor, the invention is not intended to embrace only audio, but rather the scope of the invention generally applies to a method and system for generating a special effect from a digital signal.

Figure 1:
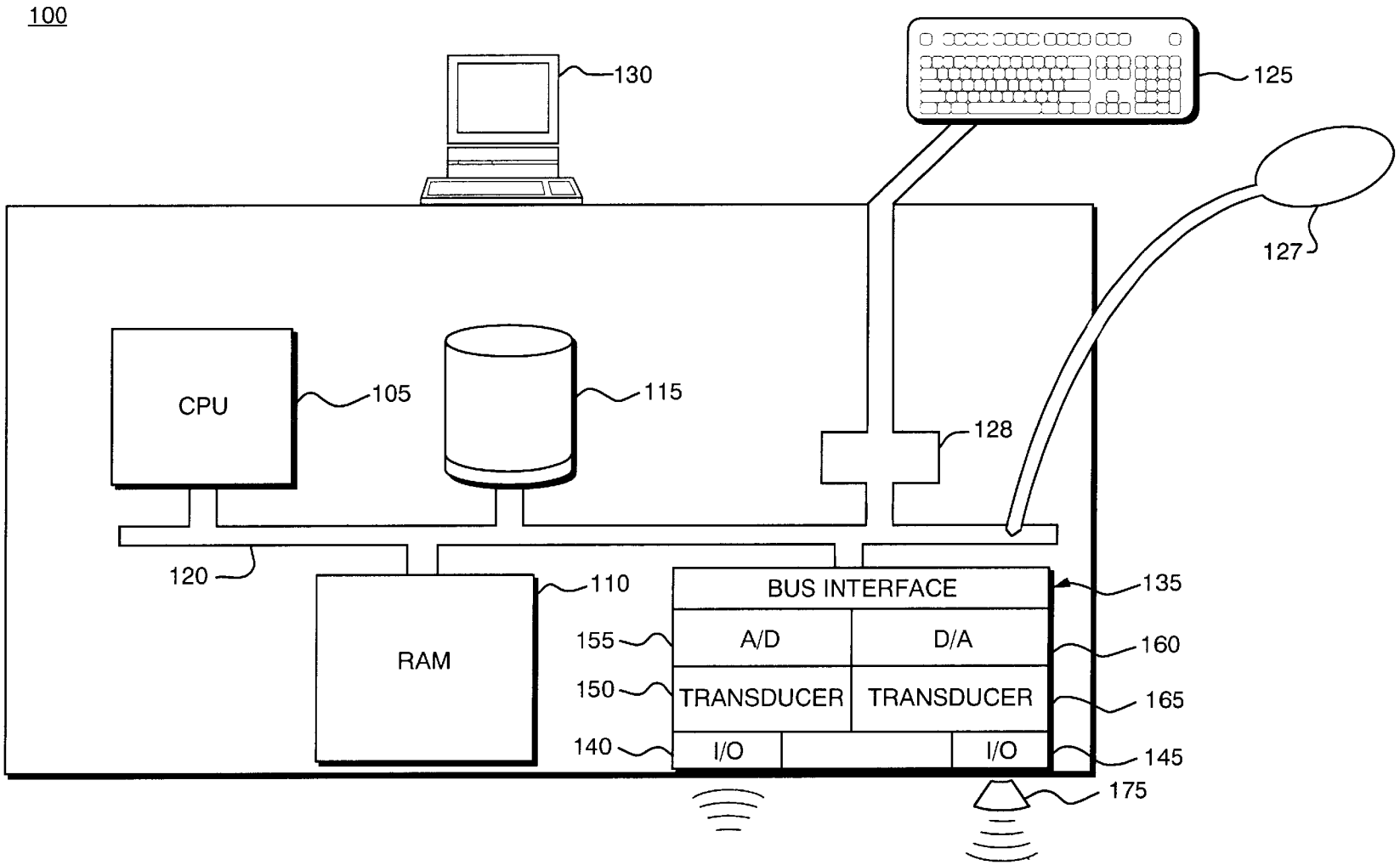
FIG. 1 (PRIOR ART)
FIG. 1 is a schematic diagram of a computer system suitable for implementing a system for aligning two signals to be mixed together so as to avoid cancellation of certain frequency components in the combined signal.

Referring to FIG. 1 there is a shown a schematic diagram of a computer system configured as a digital audio workstation (DAW) for practicing the present invention. The computer system may be programmed using typical computer programming languages such as C or C++ which may then be compiled into object code and linked into code executable by the computer system, using a suitable compiler and linker as those of ordinary skill in the art will readily understand. Computer system 100 includes a central processing unit (CPU) 105 for executing computer instructions, a random access memory (RAM) 110 for storing the computer instructions and other data, and a non volatile memory 115 such as a hard disk or CDROM drive for permanently storing data and information. Computer system 100 further includes a computer bus 120 that permits communication among the CPU 105, RAM 110, and non-volatile memory 115. A keyboard 125 connects to computer system 100 for entering alphanumeric data into computer system 100 via input controller 128, and a mouse or "point and click" device may be optionally utilized as a selection device, 127. A display monitor 130 is also connected to computer system 100 for displaying text and graphics data generated by the computer system 100.

Computer system 100 further includes an audio adapter 135 for receiving and transmitting analog audio signals. The audio adapter 135 includes an audio input port 140 for receiving an audio signal and an audio output port 145 for transmitting an audio signal to audio speakers 175 for generating sound. Audio input port 140 interfaces to a transducer 150 for converting the acoustic energy into electrical energy. An Analog-to-Digital (A/D) converter 155 samples the resulting electrical signal and generates a digital representation of the signal. Similarly, a Digital-to-Analog (D/A) converter 160 interfaces to a transducer 165 at audio output port 140 for converting a digital signal to an analog signal, prior to transmission by the transducer 165 to the audio speakers 175. The audio adapter 135 includes a computer bus interface 170 for transmitting or receiving digital data over communications bus 120 to or from the other components of computer system 100.

Computer system 100 may be programmed, using, for example, the computer programming languages referred to above or possibly other computer programming languages, to generate a special effect of interest for an audio signal. The system and method, according to the present invention, are implemented in software and are executable on the CPU 105 of computer system 100.

Figure 2:
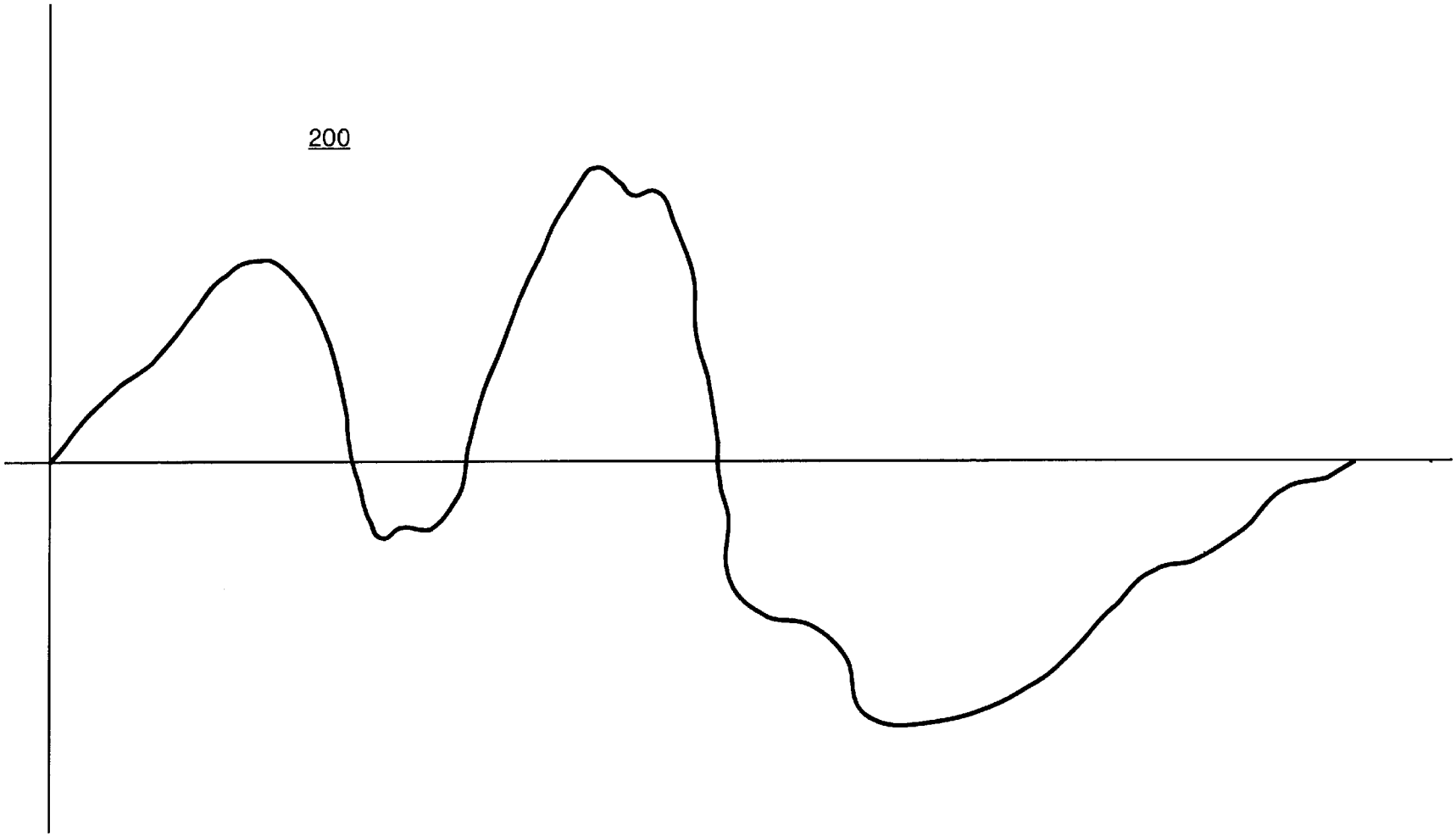
FIG. 2 depicts an analog signal representative of a captured audio signal.
Figure 3:
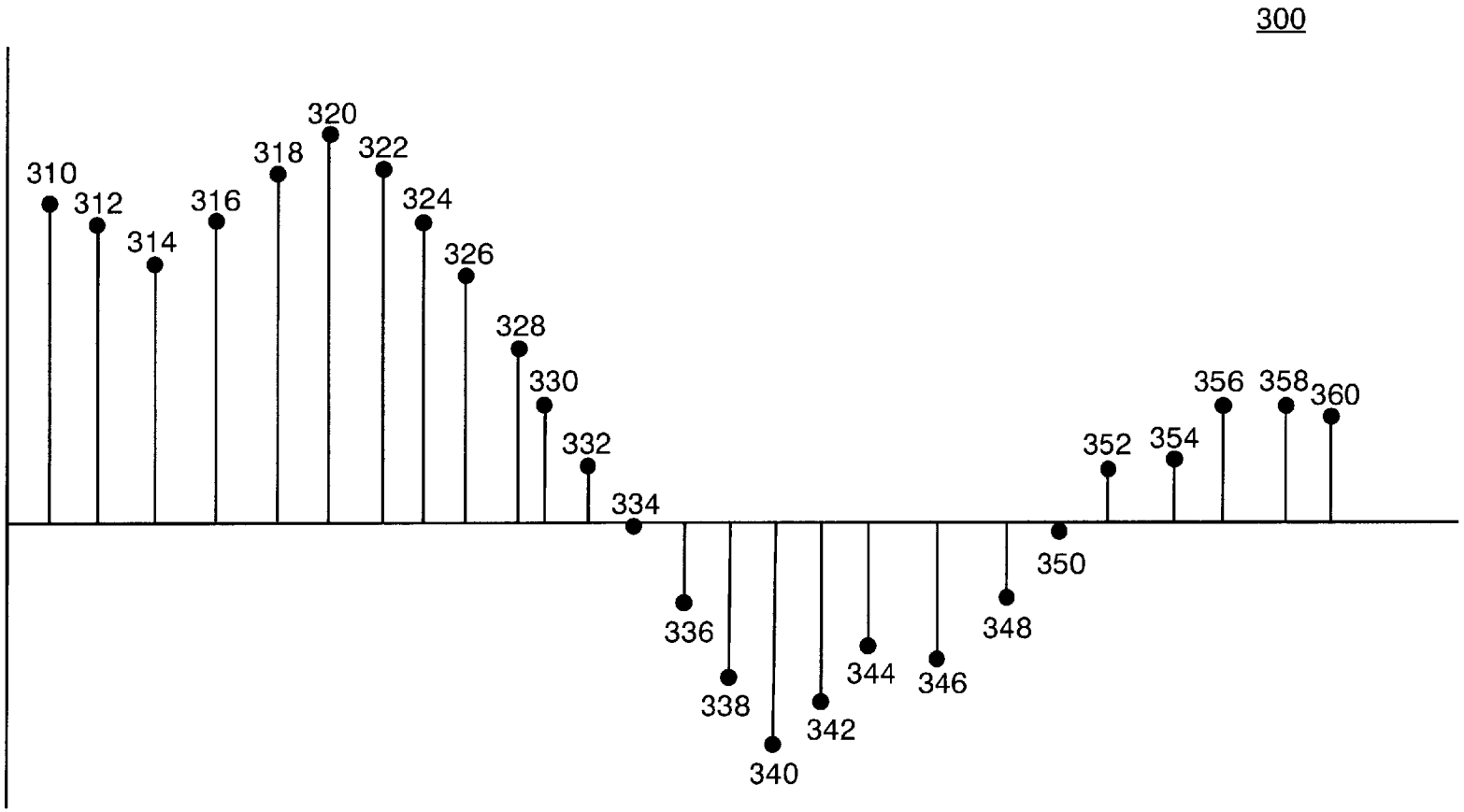
FIG. 3 depicts a digital signal corresponding to the analog signal of FIG. 2.

In one practice of the invention, a stream of acoustic energy is received by computer system 100 at audio input port 140. The audio may represent voiced or unvoiced audio. Unvoiced audio may include, but is not limited to, sound generated by musical instruments such as a drum, horn, or cymbal and also sounds produced by nature such as thunder. Transducer 150 converts the received acoustic signal to an electrical signal, as represented by the analog, audio signal 200 of FIG. 2. Audio signal 200 is sampled at periodic intervals by the A/D converter 155 and the resulting sample values are quantized to generate a corresponding digital signal 300, as shown in FIG. 3. The audio signal is typically sampled at 44.1 kHz or 48 kHz, but those of ordinary skill in the art will recognize that other sampling rates may be used and still be within the scope of the invention. After the A/D conversion and quantization by audio adapter 135, digital sample values $\{x_i\}$ are produced and sent via computer bus 120 to be stored in the RAM 110 for processing by software that implements the present method for generating a special effect during the playing of the audio waveform. The A/D converter 155 may generate 16 or 24 bit values for each $x_i$ sample, depending on the specific A/D converter that is employed. The 16 or 24 bit values are converted to a 32 bit IEEE floating point format with 0 dB as digital full scale. It is the 32 bit IEEE floating point format that is used in implementing the system and carrying out the method of the present invention. One of ordinary skill in the art will recognize that A/D converters suitable for practicing the invention are readily available in the commercial marketplace.

In one embodiment of the invention an interesting special effect is generated for a digital waveform 300 consisting of sample values 310 through 360 as now described. The digital waveform 300 of FIG. 3 is utilized for illustrative purposes. A first wavefragment 305 consisting of a sequence of contiguous samples, shown as reference numbers 310 through 330 in FIG. 3, is selected from all the samples of the digitized waveform 300. A wavefragment is a short snippet of audio that captures the timbre of the audio for a period of time. This sequence is, for illustrative purposes only, identified as $\{x_1, \ldots, x_n\}$. The sample values are normalized to produce a complimentary sequence $\{X_1, \ldots, X_n\}$ of digital values. The width of the wavefragment, or in other words the number of consecutive samples selected from the waveform, is determined by the user to define a frequency associated with the special effect of interest. A snippet of N sample values corresponds to a period of N samples/cycle. Fractional periods such as 101.5 samples/cycle are possible as will be described later in this description.

In one practice of the invention, the frequency of the selected samples is user selectable by playing a note on a MIDI, Musical Instrument Digital Interface, device that is connected to computer system 100. The MIDI interface is a standard for sending digitally encoded music between electronic devices such as between a synthesizer and a computer. A note played on the MIDI device is identified by computer system 100 and the width of the wavefragment is determined consistent with the frequency of the note. Alternatively, a user inputs the desired frequency through conventional methods, using the keyboard or mouse of the computer system 100. One of ordinary skill in the art will recognize that the current invention is not limited to a selection of a specific number of samples, but is general enough to cover a selection of any number of contiguous samples from the digitized waveform 300.

The samples corresponding to the normalized sequence $\{X_1, \ldots, X_n\}$ are chosen from the waveform 300 such that the central region of the wavefragment corresponds to a region of the signal that most identifies a full-scale rise of the signal from negative polarity to positive polarity. Letting the center point of the chosen wavefragment be designated as $x_c$, the sample values immediately before and after $x_c$ are therefor designated $x_{c-1}$ and $x_{c+1}$ respectively. In mathematical terms, the center of the wavefragment is chosen from the sequence of consecutive digital values such that the expression $|X_{c-1}+1|+|X_c|+|X_{c+1}-1|$ is a minimum. Acoustically, these expressions describe a rapid reversal in the signal's polarity at the center point of the wavefragment. A full-scale low to a high transition of the signal is made within three sample values.

In one embodiment of the invention, the sample $x_c$ partitions the first wavefragment into two wavefragment segments, whereby the low segment of the first wavefragment consists of samples $\{x_1, \ldots, x_{c-1}\}$, and the high segment of the first wavefragment consists of samples $\{x_c, \ldots, x_n\}$ with n=2(c−1).

Still referring to the digital waveform of FIG. 3, a second wavefragment or sequence of contiguous sample values, shown as reference numbers 340 through 360 in FIG. 3, is selected from the total number of samples of the digitized waveform 300. This sequence is, for illustrative purposes, designated as $\{y_1, \ldots, y_m\}$. The second wavefragment of selected sample values is generally chosen so that there are no common samples with the first sequence, but this is not a requirement and the selected samples of the second sequence may overlap with the first wavefragment. In the preferred embodiment of the invention, the number of selected samples in the second wavefragment is the same as the first wavefragment, but again this is not a requirement. Consequently in the preferred embodiment, m and n are equal and the second wavefragment will be hereafter identified as $\{y_1, \ldots, y_n\}$.

The sample values $\{y_1, \ldots, y_n\}$ are also normalized to produce a complimentary sequence $\{Y_1, \ldots, Y_n\}$. As was earlier stated, the width of the sequence is typically chosen to be consistent with the wavefragment $\{x_1, \ldots, x_n\}$, but again this is not necessary. The width of the second wavefragment can be any desired number of contiguous sample values, either a shorter or longer width than the chosen $x_i$ samples.

The samples corresponding to the normalized sequence $\{y_1, \ldots, y_n\}$ are again chosen from the waveform 300 such that the central region of the sequence corresponds to a rapid rise of the signal from negative polarity to positive polarity. Letting the center point of the chosen wavefragment be designated as $y_c$, the sample values immediately before and after $y_c$ are similarly designated $y_{c-1}$ and $y_{c+1}$ respectively. In mathematical terms, the center sample of the second wavefragment is chosen such that the expression $|Y_{c-1}+1|+|Y_c|+|Y_{c+1}-1|$ is a minimum. Again, this expression identifies a rapid rise in the polarity of the audio signal for the second wavefragment. It is seen that a low to high transition is made within three sample values. The sample $y_c$ divides the second wavefragment into two wavefragment segments. In one embodiment of the invention, the sample $y_c$ partitions the second wavefragment into the two wavefragment segments, whereby the low segment of the second wavefragment consists of samples $\{y_1, \ldots, y_{c-1}\}$ and the high segment of the second wavefragment consists of samples $\{y_c, \ldots, y_n\}$ with n=2(c−1).

In a further embodiment of the invention, a crossfading operation is performed at both a macro level between the two wavefragments $X_i$ and $Y_i$ to generate the special effect according to the present invention, while at the same time a crossfading operation proceeds at a micro level between the high and low wavefragment segments of each waveform. Crossfading of one segment of audio data into a different segment involves an ordered transition from the first segment of the audio data to a second segment of the audio data. In the present invention, a first crossfading operation is performed between the low and high segments of the first wavefragment. The high segment is crossfaded into the low segment. A second crossfading operation is also performed between the high and low segments of the second wavefragment in the same manner as the crossfade for the first wavefragment. While these two crossfading operations are performed at the micro level, a further crossfading operation is performed at a macro level between the first and second wavefragments using the values generated by the crossfading at the micro levels.

Having selected the two wavefragments from the digital waveform 300, the special effect, according to the present invention, is further described. For illustrative purposes, the first wavefragment is represented by the normalized samples $\{X_1, \ldots, X_n\}$, corresponding to samples $\{x_1, \ldots, x_n\}$, and having a low wavefragment segment $\{X_1, \ldots, X_{c-1}\}$ and a high wavefragment segment $\{X_c, \ldots, X_n\}$. The wavefragment is partitioned into low and high wavefragment segments about the sample value $X_c$, as earlier defined. In a preferred embodiment, the low and high segments of the wavefragment each include "c−1" sample values. However, it is not necessary to the present invention that the high and low wavefragment segments have the same number of sample values.

The second wavefragment is represented by the normalized samples $\{Y_1, \ldots, Y_n\}$, corresponding to the samples $\{y_1, \ldots, y_n\}$, and having a low wavefragment segment $\{Y_1, \ldots, Y_{c-1}\}$ and a high wavefragment segment $\{Y_c, \ldots, Y_n\}$. The wavefragment is also partitioned into low and high wavefragment segments about the sample value $Y_c$. The sample $Y_c$ is selected in the same manner as earlier described for $X_c$. Again, the low and high segments of the wavefragment each include "c−1" sample values. Again preferably, the low and high segments of the wavefragment each include "c−1" sample values. However, it is not necessary to the present invention that the high and low wavefragment segments have the same number of sample values.

Crossfading at the micro level involves generating a sequence of digital values that reflects the weighted sum of the corresponding sample values of the low and high wavefragments. In one embodiment of the present invention, the second wavefragment segment crossfades to the first wavefragment segment. However, those of ordinary skill in the art will recognize that alternatively the first wavefragment segment may crossfade to the second wavefragment segment at the micro level.

Crossfading, according to the present invention at the micro level, involves generating a resulting digital value that is the weighted combination of the sample values from the high and low wavefragment segments. Mathematically, the crossfading operation generates a digital sample from the expression $k_1(i)X_i+k_2(j)X_j$ where $k_1$ and $k_2$ are coefficients that that depend on the sequence of digital samples, and $X_i$ and $X_j$ are the normalized values of the $x_i$ and $x_j$ from the low and high wavefragment segments. Because the second wavefragment segment is crossfaded into the first wavefragment segment, the values of $k_2(j)$ progressively decrease from 1.0 to 0 as the value of j increases, and the values of $k_1(i)$ correspondingly increase from 0 to 1.0 as the value of i increases. In a wavefragment having a center value of $x_c$ as described above, there are preferably "c−1" digital samples in the low wavefragment segment and another "c−1" digital samples in the high wavefragment segment. In one practice of the invention, the coefficients, $k_1(j)$ and $k_2(i)$, are specified in increments of 1/(c−2) increments. Therefor, the coefficient $k_1$ increases from 0 to 1.0 in increments of 1/(c−2) and $k_2$ decreases from 1.0 to 0 in increments of 1/(c−2).

By example and for illustrative purposes only, a wavefragment consisting of eight digital samples has a low wavefragment segment with the samples $\{x_1, x_2, x_3, x_4\}$ and a high wavefragment segment with the samples $\{x_5, x_6, x_7, x_8\}$. The associated normalized values are $\{X_1, \ldots, X_8\}$. The crossfade from the high wavefragment segment to the low wavefragment segment involves the following calculations to derive a crossfaded result, which is designated as $(C_xR)_i$:

$$(C_xR)_1=1.0X_5+0X_1$$

$$(C_xR)_2=(2/3)X_6+(1/3)X_2$$

$$(C_xR)_3=(1/3)X_7+(2/3)X_3$$

$$(C_xR)_4=0X_8+1.0X_4$$

In general for a wavefragment $\{x_i, \ldots, x_c, \ldots, x_n\}$, with n=2(c−1), which is partitioned into two wavefragment segments, a low wavefragment segment $\{x_1, \ldots, x_{c-1}\}$ and a high wavefragment segment $\{x_c, \ldots, x_n\}$, the crossfade results are calculated as follows:

$$(C_xR)_1=(1.0)X_c+0X_1$$

$$(C_xR)_2=((c-3)/(c-2))X_{c+1}+(1/(c-2))X_2$$

$$(C_xR)_j=((c-j-1)/(c-2))X_{c+j-1}+((j-1)/(c-2))X_j \ldots$$

$$(C_xR)_{c-1}=0X_n+1X_{c-1}$$

Similar to the crossfade operation on the first wavefragment, a second crossfade operation is performed on the second wavefragment, which consists of the samples $\{y_1, \ldots, y_c, \ldots, y_n\}$. The associated normalized values are $\{Y_1, \ldots, Y_c, \ldots, Y_n\}$. Mathematically, the crossfading operation for the second wavefragment generates a digital sample from the expression $k_1(i)Y_i+k_2(j)Y_j$ where $k_1$ and $k_2$ are again coefficients that depend on the sequence of digital samples, and the $Y_i$ and $Y_j$ are the normalized values of the $y_i$ and $y_j$ from the low and high wavefragment segments respectively. Because the second wavefragment segment is again crossfaded into the first wavefragment segment, the value of $k_2(j)$ progressively decreases from 1.0 to 0 as the value of j increases, and the value of $k_1(i)$ correspondingly increases from 0 to 1.0 as the value of i increases. In a wavefragment having a center value of $y_c$ as described above, there are "c−1" digital samples in the low wavefragment segment and another "c−1" digital samples in the high wavefragment segment. In one practice of the invention, the coefficients, $k_1(j)$ and $k_2(i)$, are specified in increments of 1/(c−2) increments. The coefficient $k_1$ increases from 0 to 1.0 in increments of 1/(c−2) and likewise $k_2$ decreases from 1.0 to 0 in increments of 1/(c−2).

In general for a wavefragment $\{y_i, \ldots, y_c, \ldots, y_n\}$, with n=2(c−1), which is partitioned into two wavefragment segments, a low wavefragment segment $\{y_1, \ldots, y_{c-1}\}$ and a high wavefragment segment $\{y_c, \ldots, y_n\}$, the crossfade results are calculated as follows:

$$(C_yR)_1=1Y_c+0Y_1$$

$$(C_yR)_2=((c-3)/(c-2))Y_{c+1}+(1/(c-2))Y_2 \ldots$$

$$(C_yR)_j=((c-j-1)/(c-2))Y_{c+j-1}+((j-1)/(c-2))Y_j \ldots$$

$$(C_yR)_{c-1}=0Y_n+1Y_{c-1}$$

The crossfade operations for both the first and second wavefragments may be repeated or looped to sustain the crossfade effect at the micro level of crossfading. In other words, after having calculated the crossfade results $(C_xR)_{c-1}$ or $(C_yR)_{c-1}$ the crossfade operation may continue by looping back to the start of the crossfade and restarting the crossfade again. The crossfade result $(C_xR)_c$ is thus calculated as $(C_xR)_1$, and similarly $(C_yR)_c$ is calculated as $(C_yR)_1$. The additional or further crossfade results for the crossfade between the high and low wavefragment segments are thus a repetition of the initial crossfade results.

The number of times that the crossfade is repeated is user selectable, and thus the invention provides a method for generating fractional sample periods as earlier disclosed.

The sample period of the wavefragment relates to the width of the wavefragment. As was previously described a wavefragment having N sample values is considered to have a sample period of N samples/cycle. In one embodiment of the invention by alternating the width of the wavefragment during looping, support for fractional periods can be implemented. For example to support a period of 101.5 samples/cycle, a wavefragment of 101 sample values first crossfades at the micro level between the high and low wavefragments segments. After the first crossfade, a second crossfade is begun after looping back to the beginning of the sample values for each wavefragment segment. However, the second crossfade is performed with 102 sample values. An additional sample value from the waveform may be added to either the low wavefragment segment or the high wavefragment segment. Alternating between a crossfade of 101 samples and 102 samples thus generates an equivalent period of 101.5 samples/cycle. The method just described for supporting a fractional period of 101.5 samples/cycle can of course be generalized to support any rational fractional period. To support a period of N+(L/M) samples/cycle where N is an integer and L/M is a fraction under one, the crossfade operation is performed M−L times with N samples and L times with N+1 sample values.

In an alternative embodiment of the invention, a fractional period can be realized by generating a new set of sample values for the original wavefragment. The new sample values are derived by interpolating between the original sample values to generate sample values that correspond to the fractional period of interest. For example to generate a fractional sample period of 4.5 samples per cycle, a cycle of 4 samples 4 is used to generate additional sample values when the unit of time between sample values is reduced to 0.888 (4/4.5) instead of the original 1.0 units of time. With the original cycle having the sample values labeled as $S_1$, $S_2$, $S_3$ and $S_4$, new sample values are generated as $S_1$, $0.111S_1+0.889S_2$, $0.222S_2+0.778S_3$, $0.333S_3+0.667S_4$, $0.444S_4+0.556S_1$, $0.555S_1+0.445S_2$, $0.666S_2+0.334S3$, $0.777S_3+0.223S_4$, $0.888S_4+0.112S_1$. After cycling through the samples two times, nine sample values are produced by interpolation. Consequently a sample period of 4.5 samples/cycle (9 samples/2 cycles) is attained. In general, fractional sample periods such as N.M are supported by decreasing the unit of increment between sequential samples to N/(N.M) of the original value. Proper operation during looping is obtained by interpolating between the last and first sample values. One of ordinary skill in the art will readily understand the interpolation process, and thus for sake of brevity the mechanics of interpolation will not be described further.

While two alternative methods have been described for generating fractional periods, one of ordinary skill in the art will recognize that other methods are also generally known or deriving fractional periods, and thus the concept of using fractional periods in the current invention is not limited to the disclosed methods.

Having described the crossfade operation within the individual wavefragment segments at the micro level, the crossfade operation at the macro level that is performed between the two wavefragments will now be described.

As a result of the crossfading at the micro level, a sequence of digital values are generated for both the first and second wavefragments. These crossfaded results produce a finite sequence of digital values, $\{(C_xR)_1, \ldots, (C_xR)_p\}$, for the first wavefragment and similarly a second finite sequence, $\{(C_yR)_1, \ldots, (C_yR)_p\}$, corresponding to the second wavefragment. The $(C_xR)_j$ and $(C_yR)_j$ values are determined by the methods that were previously described.

The crossfade at the macro level consists of a progressive transition from the first wavefragment to the second wavefragment, using the digital values generated for each wavefragment during the crossfade at the micro level for the low and high wavefragment segments. Consequently, a crossfade involves the weighted combination of the two digital sequences generated by the crossfade at the micro level for the first and second wavefragments. The crossfade or transition is from the first wavefragment to the second wavefragment, and thus, in the initial part of the crossfade operation, the result will be more heavily weighted toward the values generated for the first wavefragment and later, in the crossfade operation, the result will favor the values generated for the second wavefragment.

In the following description of the crossfade operation at the macro level, the values generated for the first wavefragment are identified as $\{CR_1, \ldots, CR_p\}$ and the values generated for the second wavefragment are identified as $\{ry_1, \ldots, ry_p\}$. In the preferred embodiment the weighted coefficients, used in the crossfade operation, are specified in increments of 1/(p−1). However, one of ordinary skill in the art will recognize that other weighting schemes for the coefficients may be used which are considered to be within the scope and spirit of the invention. The values of the weighted coefficients are specified such that there is a progressively increasing component of the wavefragment that is the end result of the crossfading operation at each stage of the procedure. Mathematically, at the macro level the result of the crossfade operation, which is identified by the variable $R^M$ is as follows:

$$R^M{}_1=1(C_xR)_1+0(C_yR)_1$$

$$R^M{}_2=((p-2)/(p-1))(C_xR)_2+(1/(p-1))(C_yR)_2 \ldots$$

$$R^M{}_j=((p-j)/(p-1))(C_xR)_j+(j/(p-1))(C_yR)_j \ldots$$

$$R^M{}_p=0(C_xR)_p+1(C_yR)_p.$$

After generating each of the $R^M{}_j$ digital values as described above, the value of $R^M{}_j$ is reconverted from a normalized form to produce a digital value that is input to the Digital-to-Analog (D/A) converter 160 to generate the audio special effect of interest through transducer 165.

As was described previously for the crossfade at the micro level, the crossfade operation at the macro level may also loop to increase the duration of the special effect. Looping involves restarting the crossfade operation from the beginning and performing the crossfade operation over again. Consequently after generating $R^M{}_p$, the crossfade is restarted with the generation of $R^M{}_1$ again as described above. The coefficients for weighting the influence of each value are also maintained as previously calculated. The user selectively determines the frequency of the looping process and thus the duration of play for the special effect.

After completing the specified looping operations at the macro level, the audio is forwarded and a new wavefragment is selected as determined above. Again the digital samples are analyzed to determine a center value for the newly selected wavefragment which most closely exhibits a full-scale rise in the signal from negative to positive polarity. Having selected the new wavefragment, the generation of the special effect continues with the previously designated second wavefragment becoming the first wavefragment in the process and the new wavefragment becomes the second wavefragment.

Figure 4:
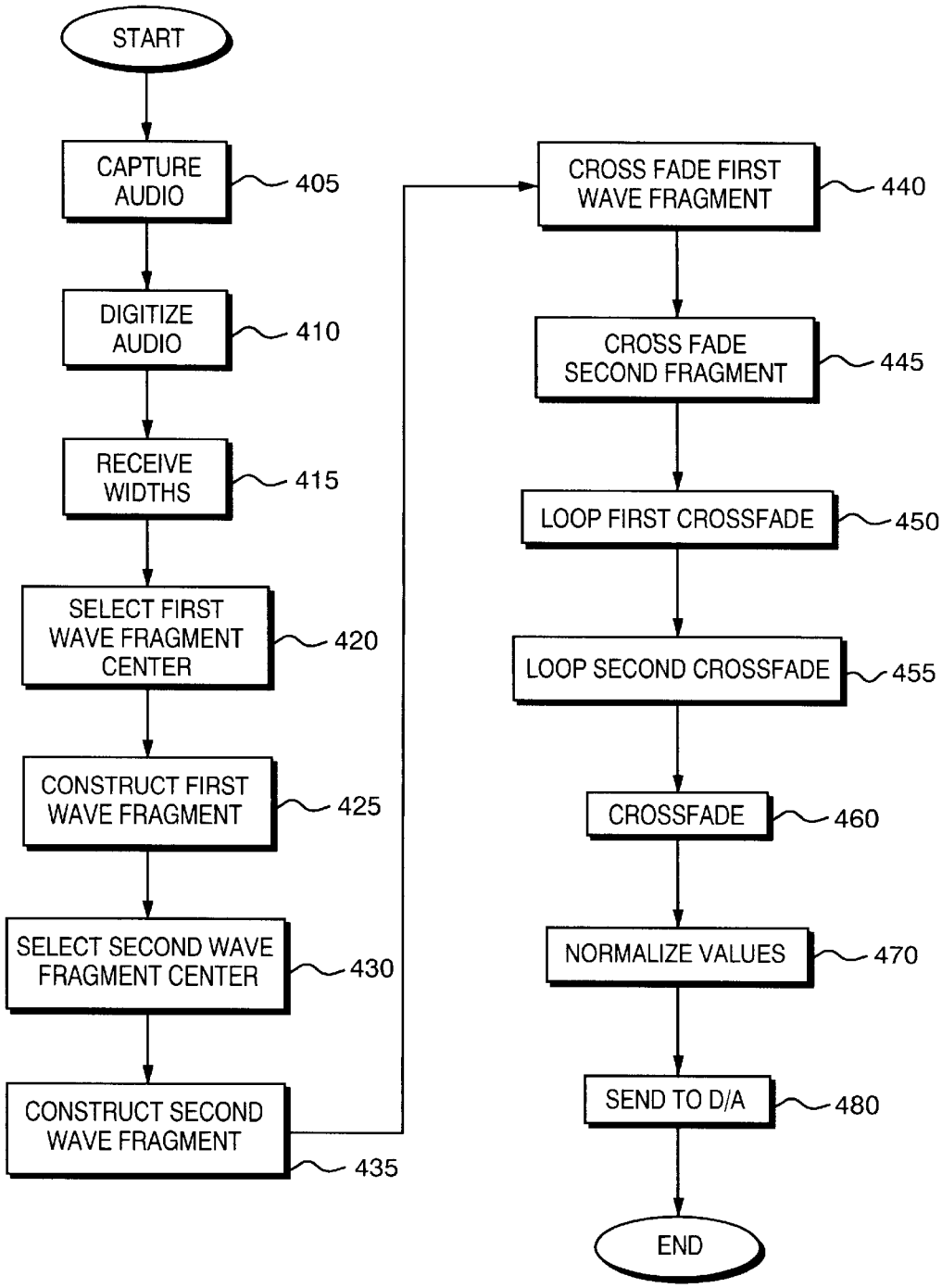
FIG. 4 is a flow chart of the steps for generating a special effect according to the present invention.

Having described in detail the generation of the special effect of interest with regard to a first and second wavefragment, FIG. 4 summarizes the process in a flow chart diagram. Initially as shown in step 405, the analog audio stream to which the special effect will be applied is captured. The captured audio is digitized, quantized, normalized and stored in the memory of the computer system 100, as shown in step 410. In step 415, user input is received to specify the width of the first and second wavefragments to be selected from the digitized audio. The digitized audio is investigated in step 420 to select a center sample for the first wavefragment. Having selected a center sample from the digitized waveform the first wavefragment is constructed by selecting consecutive digital samples to the left and right of the center sample up to the user specified width for the wavefragment, as shown in step 425. Similarly, the digitized audio is investigated in step 430 to select a center sample for the second wavefragment, and the second wavefragment is constructed by selecting consecutive digital samples to the left and right of the center sample up to the user specified width for the wavefragment, as shown in step 435. In step 440, a crossfade operation is performed between the upper and lower portions of the first wavefragment so that there is a progressive transition from the upper portion of the wavefragment to the lower portion of the wavefragment. Likewise, in step 445, a second crossfade operation is performed between the upper and lower portions of the second wavefragment so that there is a progressive transition from the upper portion of the wavefragment to the lower portion of the wavefragment. In step 450, the crossfade operation for the first wavefragment is repetitively performed by looping back to the first crossfaded result after completion of a crossfading cycle according to a user specified frequency. Consistent with the looping procedures for the first wavefragment, in step 455, the crossfade operation for the second wavefragment is repetitively performed by looping back to the first crossfaded result after completion of a crossfading cycle according to a user specified frequency.

Having generated the crossfaded results at the micro level for each of the two wavefragments, a crossfade is performed in step 460 using the results from the lower level crossfade operations whereby the crossfaded results from the first wavefragment are transitioned into the crossfaded results of the second wavefragment. In step 470, the crossfaded results from step 460 are converted back from normalized values, and sent in step 480 to an Digital-to-Analog converter 160 for playing at transducer 165 Having described the invention, it should be apparent to those of ordinary skill in the art that the foregoing is illustrative and not limiting. Numerous modifications and other embodiments are within the scope of one of ordinary skill in the art and are contemplated as falling within the scope of the invention as defined by the appended claims.

I claim:

1. A method for generating a special effect for a digital signal, said method comprising the steps of:

selecting a first and second wavefragment of digital samples within said digital signal;

crossfading a first portion of said first wavefragment with a second portion of said first wavefragment and crossfading a first portion of said second wavefragment with a second portion of said second wavefragment;

in response to said previous steps of crossfading, crossfading said first wavefragment into said second wavefragment to generate said special effect.

2. The method of claim 1 wherein said selecting step further includes the step of:

normalizing said digital samples of said first and second wavefragments.

3. The method of claim 2 wherein said selecting step further includes the step of:

centering each of said first and second wavefragments about a region having a rapid rise in magnitude for the digital signal.

4. The method of claim 3 wherein said centering step further includes centering each of said first and second wavefragments about a region having a rapid rise in magnitude within at least three digital samples.

5. The method of claim 4 wherein said digital samples rapid rise in magnitude is determined by the expression $|X_{c-1}+1|+|X_c|+|X_{c+1}-1|$ where $X_{c-1}$, $X_c$, and $X_{c+1}$ are normalized values of the corresponding digital samples.

6. The method of claim 1 wherein the step of crossfading said first wavefragment into said second wavefragment to generate said special effect includes using digital values generated by the steps of crossfading a first portion of said first wavefragment with a second portion of said first wavefragment and crossfading a first portion of said second wavefragment with a second portion of said second wavefragment.

7. The method of claim 6 wherein the step of crossfading said first wavefragment into said second wavefragment to generate said special effect further includes producing a weighted sum of said digital values generated by the steps of crossfading a first portion of said first wavefragment with a second portion of said first wavefragment.

8. The method of claim 6 wherein the step of crossfading said first wavefragment into said second wavefragment to generate said special effect further includes producing a weighted sum of said digital values generated by the steps of crossfading a first portion of said second wavefragment with a second portion of said second wavefragment.

9. The method of claim 7 wherein the step of producing a weighted sum of said digital values generated by the steps of crossfading a first portion of said second wavefragment with a second portion of said second wavefragment includes applying a higher weight to said second portion of said first wavefragment.

10. The method of claim 8 wherein the step of producing a weighted sum of said digital values generated by the steps of crossfading a first portion of said second wavefragment with a second portion of said second wavefragment includes applying a higher weight to said second portion of said second wavefragment.

11. A computer readable medium incorporating instructions thereon for generating a special effect for a digital signal, the instructions including instructions for performing the steps of:

selecting a first and second wavefragment of digital samples within said digital signal;

crossfading a first portion of said first wavefragment with a second portion of said first wavefragment and crossfading a first portion of said second wavefragment with a second portion of said second wavefragment;

in response to said previous steps of crossfading, crossfading said first wavefragment into said second wavefragment to generate said special effect.

12. The computer readable medium of claim 11 wherein said selecting step further includes the step of:

normalizing said digital samples of said first and second wavefragments.

13. The computer readable medium of claim 12 wherein said selecting step further includes the step of:

centering each of said first and second wavefragments about a region having a rapid rise in magnitude for the digital signal.

14. The computer readable medium of claim 13 wherein said centering step further includes centering each of said first and second wavefragments about a region having a rapid rise in magnitude within at least three digital samples.

15. The computer readable medium of claim 14 wherein said digital samples rapid rise in magnitude is determined by the expression $|X_{c-1}+1|+|X_c|+|X_{c+1}-1|$ where $X_{c-1}$, $X_c$, and $X_{c+1}$ are normalized values of the corresponding digital samples.

16. The of claim 11 wherein the step of crossfading said first wavefragment into said second wavefragment to generate said special effect includes using digital values generated by the steps of crossfading a first portion of said first wavefragment with a second portion of said first wavefragment and crossfading a first portion of said second wavefragment with a second portion of said second wavefragment.

17. The computer readable medium of claim 16 wherein the step of crossfading said first wavefragment into said second wavefragment to generate said special effect further includes producing a weighted sum of said digital values generated by the steps of crossfading a first portion of said first wavefragment with a second portion of said first wavefragment.

18. The computer readable medium of claim 16 wherein the step of crossfading said first wavefragment into said second wavefragment to generate said special effect further includes producing a weighted sum of said digital values generated by the steps of crossfading a first portion of said second wavefragment with a second portion of said second wavefragment.

19. The computer readable medium of claim 17 wherein the step of producing a weighted sum of said digital values generated by the steps of crossfading a first portion of said second wavefragment with a second portion of said second wavefragment includes applying a higher weight to said second portion of said first wavefragment.

20. The computer readable medium of claim 18 wherein the step of producing a weighted sum of said digital values generated by the steps of crossfading a first portion of said second wavefragment with a second portion of said second wavefragment includes applying a higher weight to said second portion of said second wavefragment.

* * * * *